United States Patent [19]

Valentine

[11] Patent Number: 4,765,778

[45] Date of Patent: Aug. 23, 1988

[54] HARDENED MATERIAL SUPPORTED ROCK BOLT AND APPARATUS FOR INSTALLING SAME

[75] Inventor: Douglas G. Valentine, Sudbury, Canada

[73] Assignee: Inco Limited, Toronto, Canada

[21] Appl. No.: 62,484

[22] Filed: Jun. 12, 1987

[30] Foreign Application Priority Data

Jun. 24, 1986 [CA] Canada ..... 512255

[51] Int. Cl.[4] ..... E21D 20/02

[52] U.S. Cl. ..... 405/260; 405/269

[58] Field of Search ..... 405/260, 261, 269, 303

[56] References Cited

U.S. PATENT DOCUMENTS 4,461,600 7/1984 Norkus et al. ..... 405/260
4,655,643 4/1987 Lane et al. ..... 405/260
4,655,644 4/1987 Lane et al. ..... 405/260
4,697,960 10/1987 Pelto et al. ..... 405/260

*Primary Examiner*—David H. Corbin
*Attorney, Agent, or Firm*—Raymond J. Kenny; Edward A. Steen

[57] ABSTRACT

A rock bolt system (10) including a mechanical rock bolt (12) having an interior channel (24) therein and a feeder attachment (14). An anchor may be affixed to the distal end of the rock bolt (12). An aperture (22) extends from the rock bolt (12). The feeder attachment (14), capable of being demountably affixed to the proximal end of the rock bolt (12), supplies hardenable material to the interior channel (24) where it courses through the interior of the rock bolt (12) and exits into the bore hole (16) through the aperture (22). A breather tube (38) extending from the feeder apparatus and into the interior channel (24) permits entrapped air to escape.

14 Claims, 2 Drawing Sheets

HARDENED MATERIAL SUPPORTED ROCK BOLT AND APPARATUS FOR INSTALLING SAME

TECHNICAL FIELD

The instant invention relates to rock bolts in general and more particularly to a hollow rock bolt and a feeding apparatus adopted to introduce hardenable material into the bolt for installing the rock bolt quickly and efficiently.

BACKGROUND ART

Underground excavations are usually supported by, amongst other things, bolts or anchors inserted into bore holes drilled into the roof and sides of the excavations. The tensioned bolts cause the surrounding rock to be compressed thereby assisting in the support integrity of the opening. Oftentimes, in addition, cementitious materials (grout, shotcrete, etc.) or resin-type materials are inserted into the void between the bore hole and bolt to impart greater structural anchorage as well as to protect the bolt from the corrosive environment of the rock face.

It appears to be universally accepted that a one-pass ground support system is an ideal technique when rock bolts are employed. However, it is difficult and expensive to provide a grouted bolt which also provides immediate support and simultaneously allows for a fast turn-around time. Present techniques include an initial bolt installation followed by a second or even third reconditioning program. The additional steps have a detrimental effect on the advance rate of the heading.

To reduce interference with the advance rate, the usual approach is to install a mechanical bolt plus screen system and then follow up later with a secondary system such as grouted rebar, grouted mechanical bolt, Swellex TM, Split-set TM, etc. Each of these has one or more disadvantages such as expense, insufficient holding power, early corrosion, uncertain quality control, etc.

Mechanical bolts are considered to be a stiff system with a point anchorage at each end. Anchor shell breakage or slippage at one end or ground break-up or bolt failure at the other end makes the bolt useless. These bolts are also prone to corrosion. However, they are frequently used because they are quick to install, provide immediate support, are tensioned and can pull up protective screening close to the roof.

On the other hand, grouted or resin surrounded bolts are corrosion resistant and the full length grouting of the bolt provides an important unifying competence to the rock mass.

The grouted mechanical bolt is a common example of current bolt designs but it is very expensive because of initial hardware cost as well as intricate installation procedures. See, for example, U.S. Pat. No. 3,316,797 (Williams). Another system employs a threaded rebar which is installed with a combination of resin cartridges to provide a quick-set anchor followed by machine tensioning followed by the setting of the slower speed cartridges. This is an expensive system but relatively fast. However, quality control can be difficult to maintain.

A basic problem with grouted bolts lies with the inconvenience and damage to a grout tube or tubes which must necessarily protrude from the drill hole and through the rock bolt plate(s).

From the foregoing it is apparent that an ideal bolt should:

(1) provide immediate support;
(2) provide full column loading as opposed to point loading;
(3) be corrosion resistant;
(4) be quickly installed;
(5) use cheaper cement grouts versus resins;
(6) be easily grouted; and
(7) be reasonably priced.

There are of course, certain situations where an initial, modest cost mechanical bolt installation will last for many years and a reconditioning program not required. However, when experience dictates that a reconditioning program will probably be required, it also implies that ground conditions will deteriorate. This deterioration adds to the overall safety hazard and points to the obvious—that a good initial program is imperative.

SUMMARY OF THE INVENTION

Accordingly, there is provided a hollow bolt, threaded at least at one end, that is installed in a fashion similar to a conventional mechanical bolt with a plate washer. However, no grout tubes, for introducing grout about the bolt, are required at this stage. Rather, when grouting is desired, a feeder apparatus, including a central breather tube extending through the center of the bolt, is affixed to the exposed bottom portion of the bolt. The bolt includes at least one aperture which lies just below a seal mounted upon the breather tube when the breather tube is disposed within the rock bolt.

A hardenable material such as cementitious material (grout) or any other suitable substance (resin) is introduced into the feeding apparatus whereupon it flows through the interior of the bolt, out of the aperture, and into the bore hole.

PREFERRED MODE FOR CARRYING OUT THE INVENTION

Figure 1:
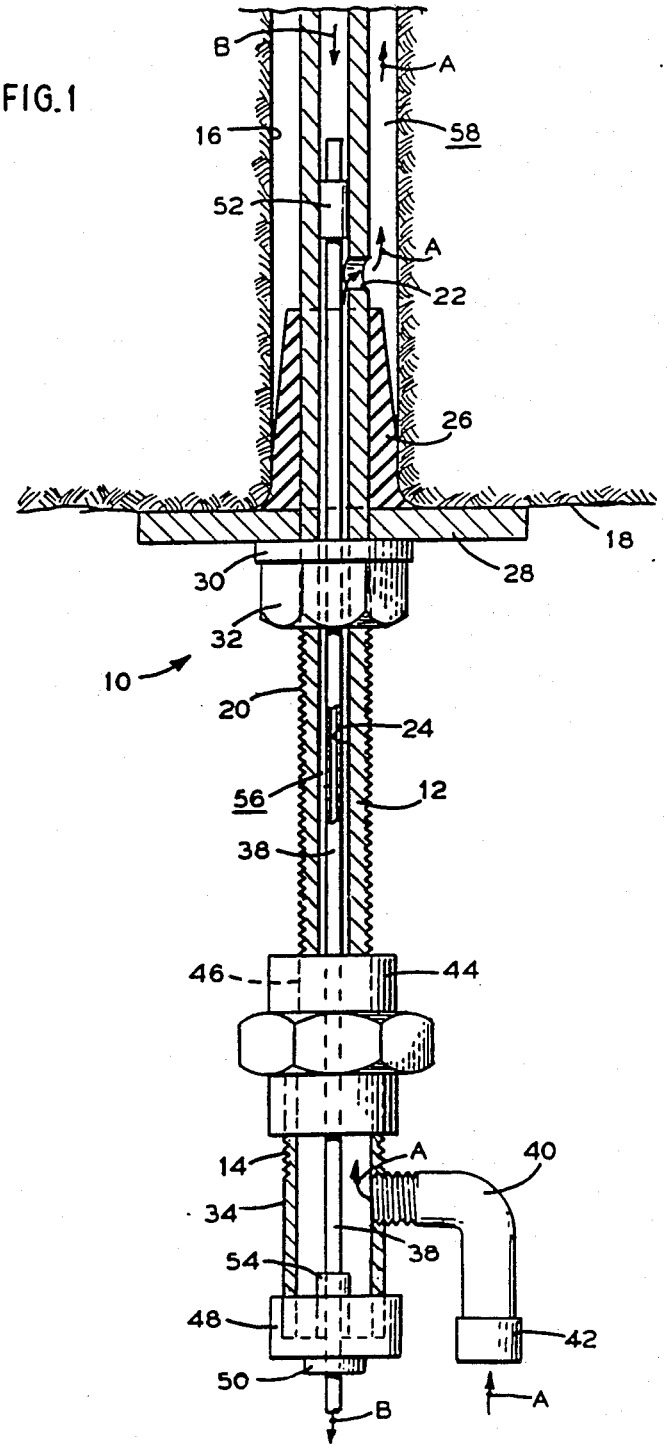
FIG. 1 is a partial cross-sectional elevation of an embodiment of the invention.
Figure 2:
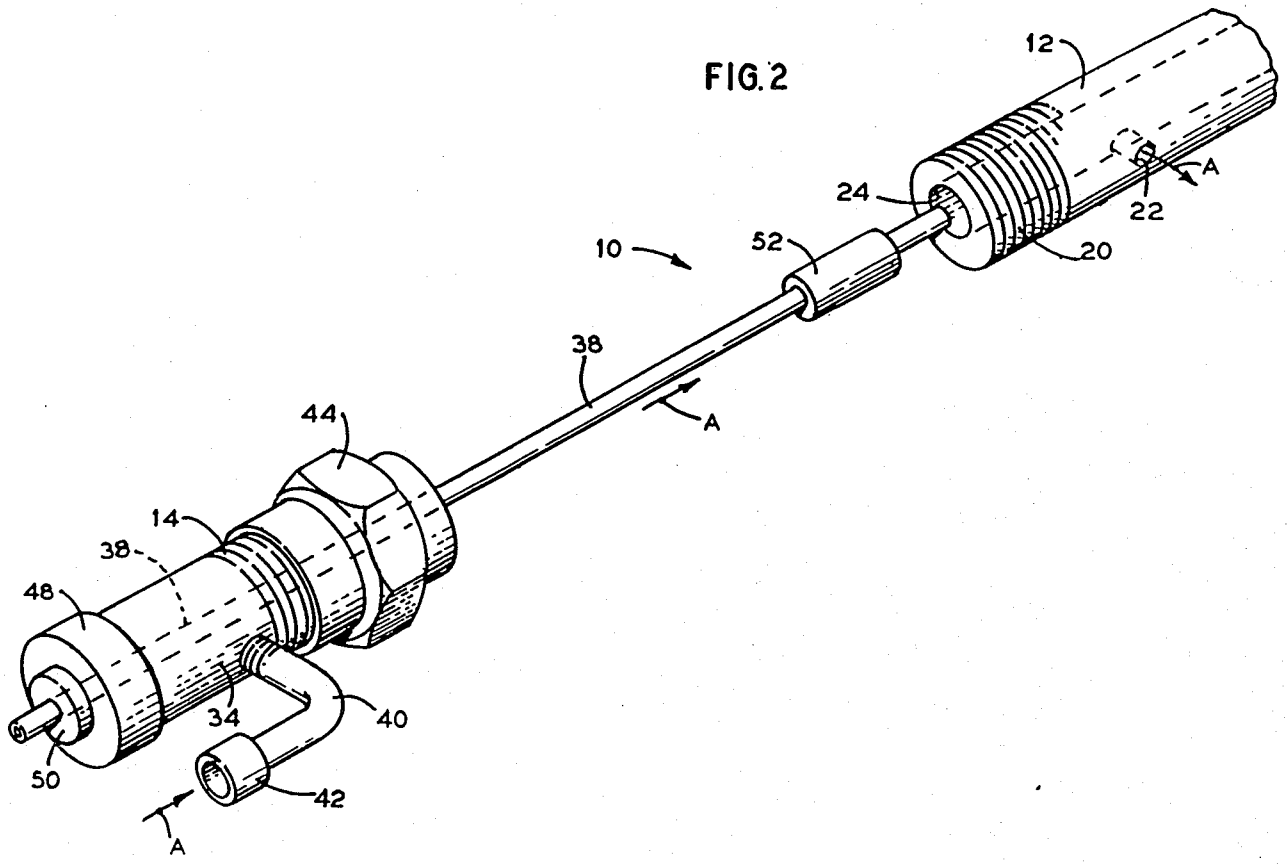
FIG. 2 is a partially expanded perspective view of an embodiment of the invention.

Referring to FIG. 1, there is shown a rock bolt system 10 comprised of a rock bolt 12 and a grouting or feeder attachment 14. The rock bolt 12 is depicted as being inserted into a bore hole 16 previously drilled into an evacuation 18.

The rock bolt 12 is essentially a high tensile steel tube including an interior channel 24 and threaded end section 20 (only the lower or proximal end is shown). The upper or distal end section (not shown) may be threaded and may include a conventional mechanical threaded expansion shell that forcefully expands against the interior of the bore hole 16 when the rock bolt 12 is rotated home. This causes the rock bolt 12 to put the ground surrounding the bore hole 16 into compression. An aperture 22, formed in the bolt 12, communicates with the interior channel 24.

In the embodiment shown, an elastic plug 26 serves to seal the bore hole 16. A bolt plate 28, washer 30, and rock bolt nut 32 serve to secure the bolt 12 in the hole 16. The bolt 12 is installed in the hole 16 in the usual manner.

The feeder attachment 14 which is demountably affixed to the bolt 12, includes a hollow body 34 having a central thin walled breather tube 38 passing therethrough. The breather tube 38 is aligned with the interior channel 24 and extends through the body 34.

The diameter of the interior channel 24 is slightly larger than the diameter of the breather tube 38 so as to permit flow of the hardenable material up into the bore hole 16.

A feeder tube 40 having a coupling 42 is affixed to the body 34. The feeder tube 40 is connected to a hardenable material source (not shown).

A union 44, which may be constructed from conventional plumbing equipment, is affixed to the body 34. The internal thread 46 of the union 44 is complementary to the thread of the end section 20.

A cap 48 closes off the body 34 and a locking washer 50 may be employed to maintain the tube 38 in position.

The breather tube 38 includes an expandable cylindrical seal 52 which is ultimately located above the aperture 22. A lower seal 54 circumscribes the breather tube 38 to seal off the body 14.

Arrows A trace the travel of the hardenable material through the system 10. Arrows B indicate the route of, first, air and then the material exiting the bore hole 16.

The invention and the manner of applying it may be better understood by a brief discussion of the principles underlying the invention.

The instant invention is especially suitable in situations where ultimately the rock bolt is to be grouted but at the time of installation, for whatever reason, it is not. This versatility allows for the heading to be completed without the need to slow down operations in order to grout the bolts. As was alluded to earlier, current designs employing extended grout tubes may be easily damaged if not grouted immediately. The instant design allows for the secure installation of the bolt with the option of later grouting. In a sense the bolt acts in a dual manner. When first installed it acts as a mechanical bolt whereas at a later point in time it may be grouted thereby exhibiting the desirable support characteristics of a grouted bolt. Indeed, it is conceivable that after installation, the bolt will not be grouted.

After the bore holes 16 are formed in a usual manner, the bolt 12 is inserted into the hole 16 and rotated to cause the shell anchor at the distal portion of the bolt 12 to forcefully expand against the rock surface in the bore hole 16. The plug 26, plate 28, washer 30 and nut 32 are then positioned on the bolt 12 as shown in FIG. 1 whereupon the nut 32 is tightened to tension the bolt 12 and compress the surrounding rock. A lower portion of the bolt 12 protrudes from the bore hole 16.

When grouting is desired, the feeder attachment 14 is affixed to the bolt 12. The union 44 is threaded onto the lower section of the bolt 12. The location of the aperture 22 is ascertained beforehand so that the expandable seal, (for example, a polymeric material) is disposed immediately above it. It is preferred to utilize one aperture 22 since a plurality of apertures 22 could weaken the bolt 12. In the event that additional apertures 22 are employed, they should be staggered along the bolt 12 in order to insure the structural integrity of the bolt 12. In any event, the seal 52 is positioned above the highest aperture 22.

A grout source (not shown), is connected to the coupling 42 and energized. The grout flow, designated by directional arrows A passes into the body 34 and through the bolt 12 in the void 56 formed between the channel 24 and the breather tube 38. The grout is then forced out through the aperture 22 and into the void 58 formed between the bolt 12 and the bore hole 16. The grout ultimately fills the void 58. Initially, the breather tube 38 allows air present in the bore hole 16 to escape into the environment through the breather tube 38 as the grout inexorably fills the void 58. See arrows B. The air flows out of the breather tube 38 in the vicinity of the cap 48. Without the breather tube 38, the flow of grout would ultimately cease resulting in an undesirable gap between the bolt 12 and the bore 16. The breather tube 38 and the interior channel 24 also act as grout return passageways after the grout has reached the end of the bore hole 16. See also arrows B. Grout exiting the breather tube 38 indicates the bore hole 16 has been filled.

Upon completion of the grout injection operation, the grout source is disconnected from the coupling 42 and the entire feeder attachment 14 is unthreaded from the bolt 12. The feeder attachment 14 may then be attached to an adjacent bolt 12 and the entire operation repeated.

It should be appreciated that although reference is made mostly to grout, any suitable hardenable material, such as cemetitious material (grout, shotcrete), polymers, or resins may be utilized.

In summary, the system 10 allows an advancing crew to install a mechanical rock bolt for immediate support and then immediately or at some later point in time commence hardenable material injection to provide permanency, strength, safety and corrosion resistance.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property of privilege is claimed are defined as follows.

1. A rock bolt system, the system comprising a rock bolt and a feeding attachment demountably affixed to the rock bolt, the rock bolt including an interior channel extending within the rock bolt, means for flowably introducing hardenable material into the feeding attachment and into the interior channel, a tube affixed to the feeding attachment and extending into the interior channel of the rock bolt, the tube and the interior channel forming a void therebetween, at least one aperture disposed in the rock bolt for routing the hardenable material from the void to the exterior of the rock bolt, a seal in the void circumscribing the tube and registered against the interior channel, the seal disposed immediately above the aperture for routing the hardenable material in the void out through the aperture and upwardly around the rock bolt.

2. The system according to claim 1 wherein the feeding attachment includes a body, the body having a closed end and an open and, means for introducing the hardenable material into the feeding attachment, a union registered with the open end of the feeding attachment and adapted to be demountably affixed to the rock bolt, and a tube protuding without the body.

3. The system according to claim 2 wherein the union includes a threaded portion for attachment to the rock bolt.

4. The system according to claim 1 wherein at least one end of the rock bolt is threaded.

5. The system according to claim 2 wherein the tube extends into the interior channel and forms a void therebetween.

6. The system according to claim 5 wherein the tube extends past the aperture means.

7. The system according to claim 1 wherein a rock bolt nut and plate are affixed to the rock bolt intermediate the feeder attachment and the aperture means.

8. A demountable feeding apparatus for introducing hardenable material into the interior of a rock bolt and the subsequent upward exit flow thereout, the feeding apparatus comprising a hollow body, the body having a closed end and an open end, a tube disposed within the body and extending thereout, means for introducing the hardenable material independently of the tube into the body, union means affixed to the body for attachment to the rock bolt, and an expandable seal affixed to the tube.

9. The apparatus according to claim 8 wherein the seal is cylindrical and disposed toward one end of the tube.

10. The apparatus according to claim 8 wherein the union means is threaded.

11. The apparatus according to claim 8 wherein a rock bolt having at least one aperture disposed below the seal is adapted for mating with the feeding apparatus.

12. A method for installing a rock bolt, the method comprising:

(a) opening a bore hole to a predetermined depth, (b) installing and securing a rock bolt into the bore hole, the rock bolt having an interior channel extending therein and at least one aperture bridging the interior channel and the exterior of the rock bolt, (c) attaching a demountable feeder attachment having a breather tube extending therefrom to the end of the rock bolt, (d) injecting hardenable material from the feeder attachment into a void formed between the breather tube and the interior channel of the rock bolt, (e) causing the hardenable material to course through the void and exit through the aperture so as to upwardly fill a second void formed between the rock bolt and the bore hole, (f) allowing air trapped within the bore hole and the hardenable material to pass through the breather tube and out to the environment through the feeder attachment and, (g) terminating the installation by detaching the feeder attachment.

13. The process according to claim 12 wherein a seal attached to the tube is inserted into the interior channel of the rock bolt to a position past the aperture.

14. The process according to claim 12 wherein a rock bolt and plate, affixed to an end of the rock bolt, are secured about the bore hole.

* * * * *